US005575132A

United States Patent [19]

Garsjo

[11] Patent Number: 5,575,132

[45] Date of Patent: Nov. 19, 1996

[54] SHINGLE INSTALLATION TOOL

[76] Inventor: Richard H. Garsjo, HC 67 Box 209, Nashua, Mont. 59248

[21] Appl. No.: 529,203

[22] Filed: Sep. 15, 1995

[51] Int. Cl.[6] ..... E04D 15/00

[52] U.S. Cl. ..... 52/749.12; 52/748.1; 52/DIG. 1; 52/127.5; 81/45

[58] Field of Search ..... 52/749.12, 749.11, 52/749.1, 748.1, 747.1, 127.5, DIG. 1, 523, 524, 750, 712; 81/45; 30/167–169; 254/25, 109; 273/84 R, 67 C

[56] References Cited

U.S. PATENT DOCUMENTS

| | | | |
|---|---|---|---|
| 969,528 | 9/1910 | Disbrow | 30/169 |
| 2,576,262 | 11/1951 | Morehead | 206/32 X |
| 3,195,266 | 7/1965 | Onanian | 52/DIG. 1 |
| 3,865,370 | 2/1975 | Rogers | 30/169 X |
| 4,009,743 | 3/1977 | Ackerman | 30/169 X |
| 4,670,932 | 6/1987 | Williams | 254/25 X |
| 5,249,767 | 10/1993 | Mellen | 254/104 X |
| 5,447,289 | 9/1995 | Callahan | 254/25 X |
| 5,459,897 | 10/1995 | Wurdack | 30/169 X |

*Primary Examiner*—Robert Canfield
*Attorney, Agent, or Firm*—Harry M. Cross, Jr.

[57] ABSTRACT

A T-Lock shingle installation tool comprises a plate having a hand grip provided therein, a pair of tapered leading insertion edges at a forward end of said plate that are separated by a recessed portion. The plate may taper from back to front, and the insertion edges each may have a knife-like forwardly projecting tapered edge. The plate may be provided with an aperture located near a back edge of the plate with the hand grip being defined between the back edge and the aperture. The method of installing interlocking shingles of the type having a broader weather-exposed section and a narrow leg section for interlocking with adjacent shingles comprises the steps of placing the tool around the leg of a shingle to be installed so as to overlay interlocking portions of such shingle, and slipping the tool beneath interlocking portions of a pair of installed shingles so as to pry up the interlocking portions and inserting the tool and the interlocking portions of the shingle to be installed simultaneously beneath the pried up portions of the installed shingles so as to interlock the shingle being installed with the installed shingles.

8 Claims, 3 Drawing Sheets

SHINGLE INSTALLATION TOOL

BACKGROUND OF THE INVENTION

1. Field of the Invention

This invention relates to tools employed by roofing installers and, more particularly, to tools employed to install composition roofing shingles.

2. Brief Description of the Prior Art

There is a class of composition roofing shingles known as T-Lock or Wind Lock shingles that are designed to interlock when applied to roof. The interlocking design of this shingle style enables the interlocked shingles to withstand high wind forces without being blown off a roof. These T-Lock shingles, as they will be called herein, are difficult to install. They have notches and tabs that must be manipulated during the installation process. Heretofore, the installer used his fingers, or chisels, nails or the end of a hammer to hook the tabs of a just-installed shingles so that another shingle could be slipped in place and interlocked with the just-installed shingle. The process was time-consuming and could result in ripped or broken shingle tabs if the installer was not careful.

SUMMARY OF THE INVENTION

The present invention provides a tool for use with T-Lock shingles that enables the quick and sure installation of the these shingles. The tool in its preferred form is a unitary, one-piece plate so formed that it can be located around a T-Lock shingle and then inserted under the tabs of a pair of just-installed shingle so as to enable the installer to slip the new shingle into interlocking engagement with the installed shingle pair.

The tool of this invention comprises a plate having a hand grip provided therein, a pair of tapered leading insertion edges at a forward end of said plate that are separated by a recessed portion. The plate may taper from back to front, and the insertion edges each may have a knife-like forwardly projecting tapered edge. The plate may be provided with an aperture located near a back edge of the plate with the hand grip being defined between the back edge and the aperture. The method of installing interlocking shingles of the type having a broader weather-exposed section and a narrow leg section for interlocking with adjacent shingles comprises the steps of placing the tool around the leg of a shingle to be installed so as to overlay interlocking portions of such shingle, and slipping the tool beneath interlocking portions of a pair of installed shingles so as to pry up the interlocking portions and inserting the tool and the interlocking portions of the shingle to be installed simultaneously beneath the pried up portions of the installed shingles so as to interlock the shingle being installed with the installed shingles.

DESCRIPTION OF THE PREFERRED EMBODIMENT

Figure 1:
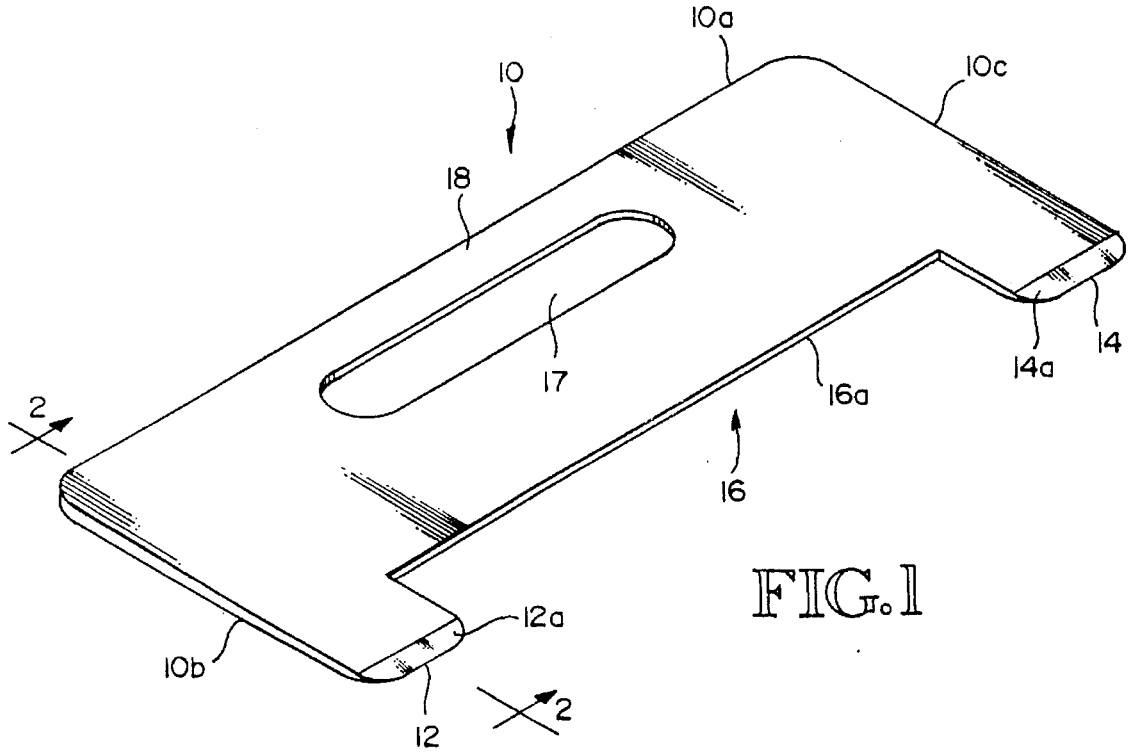
FIG. 1 is a perspective view of the T-Lock shingle installation tool of this invention.
Figure 2:
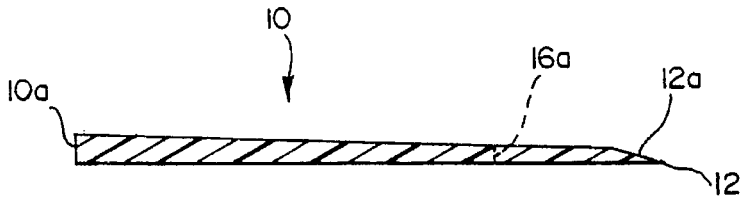
FIG. 2 is a side cross-section view taken along the line 2—2 of FIG. 1.
Figure 4:
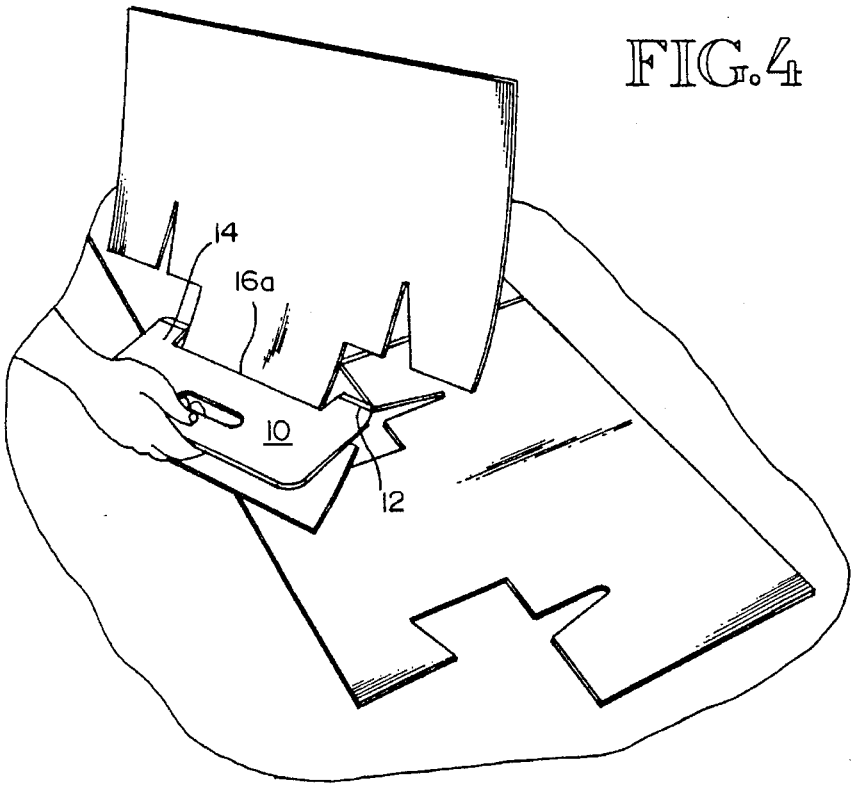
FIG. 4 is a perspective view of the FIG. 1 tool applied to a shingle to be installed, the FIG. 3 pair of shingles being seen behind the tool.

The shingle installation tool 10 comprises a unitary, one-piece plate having a back edge 10*a*, two side edges 10*b*, 10*c* that terminate at the front of the tool at front edges 12, 14, respectively, and a recessed portion 16 at the front of the tool that is defined between front edges 12, 14 as shown in FIG. 1. The plate is provided with an elongated aperture 17 positioned adjacent to the back edge 10*a* so that a hand-grip portion 18 is defined, the aperture 17 enabling a user's fingers to be inserted through the tool is indicated in FIGS. 4–7 when gripping the tool. As shown in FIGS. 1 and 2, the plate is preferably tapered from back to front, and the front edges 12, 14 are further tapered to a near-knife edge to facilitate insertion of the tool beneath an installed shingle tab. The recessed portion 16 has a width between front edges 12 and 14 that is sufficient to permit the tool to be placed around the leg of a T-Lock shingle as shown in FIG. 4 with the front edges 12 and 14 projecting beyond the plane of the shingle. The front edges 12, 14 have a width that is sufficient to cover the side tabs of the foot of a T-Lock shingle as shown in FIG. 4. The front edges 12, 14 project forwardly from the inner edge 16*a* of recessed portion 16 a sufficient distance to cover the length of the T-Lock shingle foot side tabs.

Figure 3:
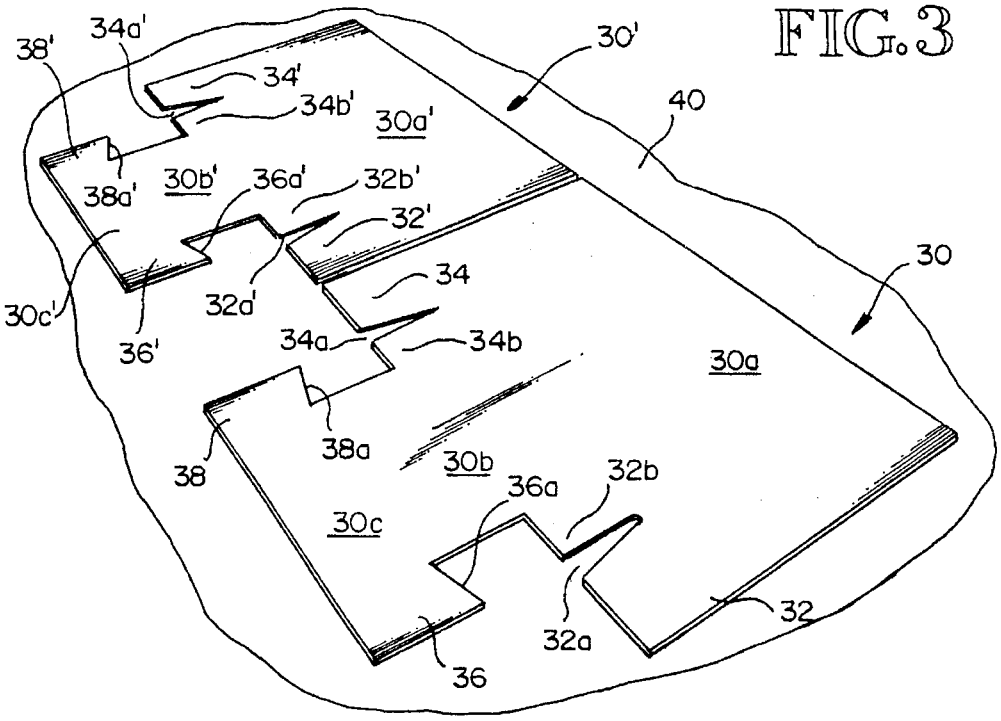
FIG. 3 is a perspective view of a pair of just-installed shingles on a sloped roof section.

As shown in FIG. 3, a T-Lock shingle 30 comprises a main body portion 30*a*, a leg portion 30*b* and a foot portion 30*c*. The main body portion 30*a* has a substantial rectangular area that is designed to be left exposed to the weather when installed on a roof, and a pair inner side tabs 32, 34 that are integral with the main body portion but separated therefrom by notches 32*a*, 34*a*, the notches and side tabs being designed to be overlapped by the next row of installed shingles and thus hidden from the weather. The foot 30*a* is provided with a pair of outer side tabs 36, 38 that have inner interlocking edges 36*a*, 38*a* that slant outwardly toward the side tabs 32, 34, respectively. Interlocking edges 36*a*, 38*a* have the same width as the main body portions 32*b*, 34*b* that are located on the inner sides of notches 32*a*, 34*a*, respectively.

As shown in FIG. 3, a row of T-Lock shingles are installed on a roofing surface 40, typically roofing paper. FIG. 3 illustrates the row by two shingles laid end to end, the element numbers or the second shingle being primed to distinguish between the two shingles. The respective adjacent notches 32*a*', 34*a*, separate the two adjacent side tabs 32', 34 from their main body portions 32*b*', 34*b*. Therefore, when tool 10 is inserted between the two adjacent installed shingles 30, 30', the tool front edges 12, 14 can be inserted beneath the adjacent shingle main body portions 32*b*', 34*b* and, by so doing, can pry those portions 32*b*', 34*b* upward without disturbing the adjacent side tabs 32', 34.

Figure 5:
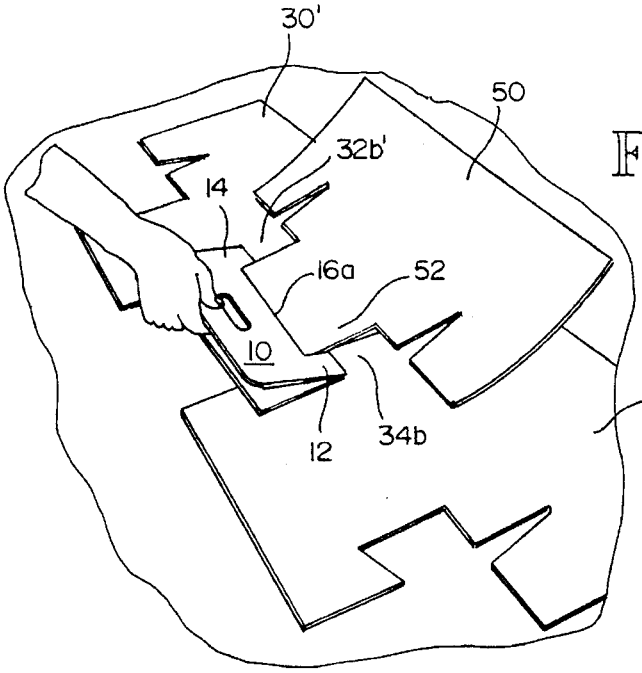
FIG. 5 is a perspective view of the FIG. 1 tool, applied to a shingle as per FIG. 4, being employed to raise the interlocking tabs of the FIG. 3 pair of shingles.
Figure 6:
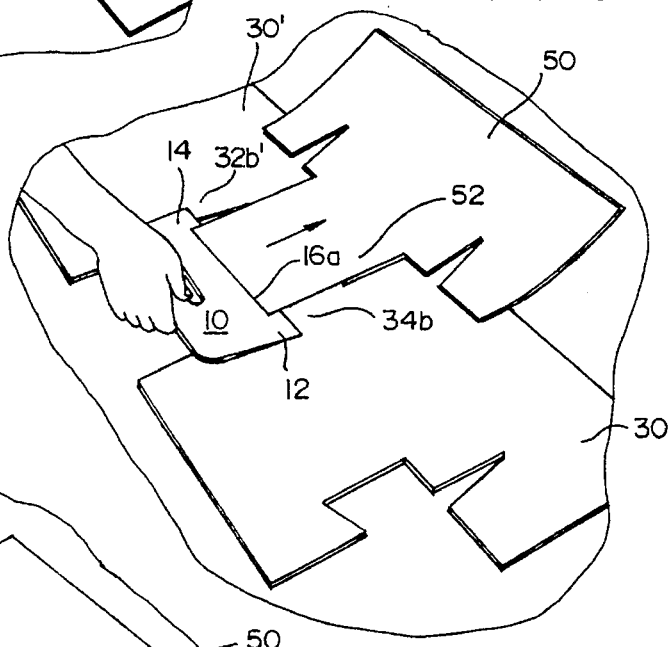
FIG. 6 is a perspective view further illustrating the installation process where the applied tool has raised the interlocking tabs of the pair of just-installed shingles so that the new shingle can be slipped into interlocking engagement with the installed shingles.

When the tool 10 is placed around a shingle 50 to be installed over shingles 30, 30', with the recess 16 in the tool enclosing the leg 52 of shingle 50 so that recess inner edge 16*a* contacts the outer surface of shingle 50, the tool's front edges 12, 14 protrude beyond the leg 52 so that those front edges can be slipped beneath the two adjacent installed shingles' portions 32*b*', 34*b*. This slipping action is accomplished by the user gripping the tool 10 with one hand as shown, while at the same time gripping the shingle 50 to installed with the other hand. As the tool is guided into the position shown in FIG. 5, the shingle 50 is held and guided into its position as shown in FIG. 5, also. Then, as the tool is shoved beneath the installed shingles, the shingle 50 is pulled so that its foot portion inner edges (corresponding to edges 36*a*, 38*a* of shingle 30) will be pulled beneath the installed shingle portions 32*b*', 34.

Figure 7:
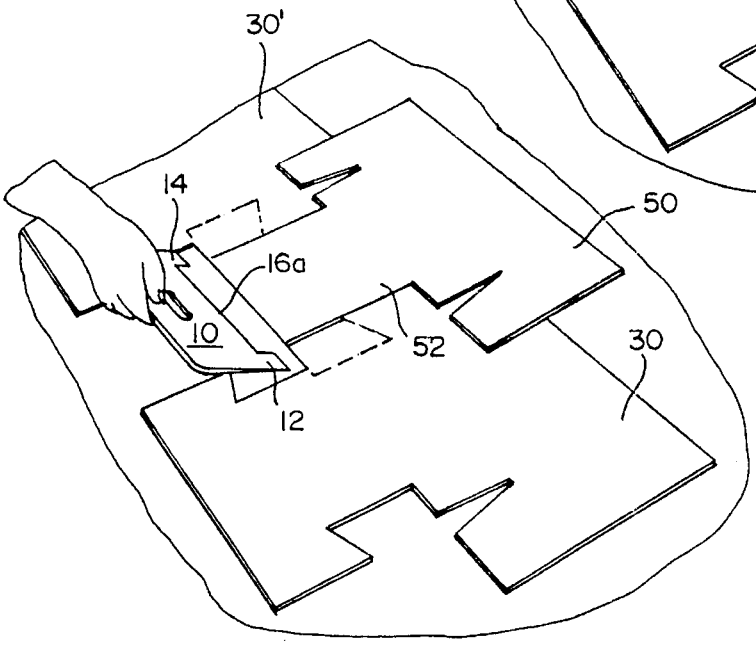
FIG. 7 illustrates the completion of the shingle installing process where the tool is removed from the new shingle, leaving the new shingle interlocked with the previously-installed FIG. 3 pair of shingles.

With the tool 10 being held at an acute angle to the roof surface as shown in FIG. 5 as it is being slipped beneath installed shingle portions 32*b*', 34*b*, those portions 32*b*', 34*b* will be pried up. Therefore, as the tool 10 continues to slip beneath the portions 32*b*', 34*b* of the installed shingles 30', 30, the outer side tabs on the foot of the shingle to be installed (corresponding to tabs 36, 38 of the installed shingle 30) will be slipped beneath the installed shingle portions 32*b*', 34*b*. This will occur because the tool front edges 12, 14 overlay the foot's outer side tabs as the tool is shoved beneath portions 32*b*', 34*b* and as the shingle 50 is pulled into engagement with the installed shingles 30, 30'. The end result is shown in FIG. 7 wherein the foot portions of the just-installed shingle 50 are shown in dashed line as they underlay the installed shingles' portions 32*b*', 34*b*. In this position, the leg of the just-installed shingle 50 overlays the joint between the installed shingles 30, 30' and the installed shingles' main body portion tabs 34, 32'.

The back to front taper of the plate of tool 10 helps in slipping the tool beneath installed shingles. Also, the knife-like taper on the upper surface of the leading edges 12*a*, 14*a* of front edges 12, 14 helps the tool to be initially inserted beneath the installed shingles' main body portions 32*b*', 34. The tool 10 can be fabricated from plastic or metal. The corners of the leading edges 12*a*, 14*a* are preferably rounded as shown in FIG. 1 so prevent the tool from hooking or catching on the corners of the installed shingles as the tool is engaged with the installed shingles.

While the preferred embodiment of the invention has been described herein, variations in the design may be made. For example, the back of the tool may be modified to permit the tool to be attached to a shingle-nailer tool. In such a modification, the hand grip portion 18 may be extended to provide a nailer mounting section for the tool; or the tool may be modified to replace the hand grip portion 18 with a nailer attachment portion. Consequently, the tool of this invention may be structured as a hand-held tool as shown in the drawings, or it may be structured as an auxiliary device for attachment to a shingle nailer, or it may be structured so that it can be used either as a hand-held or as a nailer attachment. The scope of the invention, therefore, is only to be limited by the claims appended hereto.

The embodiments of the invention in which an exclusive property is claimed are defined as follows:

1. A tool for use in installing interlocking roofing shingles which comprises a plate having hand grip means, and insertion means providing a pair of tapered leading insertion edges at a forward end of said plate that are separated by a recessed portion, said edges being spaced far enough apart that the intervening recessed portion can be placed over a locking leg of a first interlocking shingle with said edges straddling the locking leg and with said edges each overlaying one of two locking leg feet of the first interlocking shingle; said insertion means being configured and arranged so that the plate can be placed over the first interlocking shingle with the first interlocking shingle locking leg projecting forwardly of said plate and with said edges overlaying the first interlocking shingle locking leg feet, and said edges can then be inserted underneath adjacent locking side tabs of adjacent second and third interlocking shingles to place the locking leg feet underneath the adjacent locking side tabs and to place the locking leg over the second and third interlocking shingles so as to interlock the first, second and third interlocking shingles.

2. The tool of claim 1 wherein said plate tapers from back to front, and said insertion edges each have a knife-like forwardly projecting tapered edge.

3. The tool of claim 1 wherein said plate is provided with an aperture located near a back edge of said plate with said hand grip means being defined between said back edge and said aperture.

4. The tool of claim 1 wherein said plate tapers from back to front, and said insertion edges each have a knife-like forwardly projecting tapered edge; and wherein said plate is provided with an aperture located near a back edge of said plate with said hand grip means being defined between said back edge and said aperture.

5. A method of installing interlocking shingles of the type having a broader weather-exposed section and a narrow leg section for interlocking with adjacent shingles, said method comprising the steps of:

a) providing a tool for use in installing interlocking roofing shingles which comprises a plate having a hand grip provided therein, a pair of tapered leading insertion edges at a forward end of said plate that are separated by a recessed portion;

b) placing said tool around the leg of a shingle to be installed so as to overlay interlocking portions of such shingle;

c) slipping said tool beneath interlocking portions of a pair of installed shingles so as to pry up the interlocking portions and inserting the tool and the interlocking portions of the shingle to be installed simultaneously beneath the pried up portions of the installed shingles so as to interlock the shingle being installed with the installed shingles.

6. The method of claim 5 wherein said tool plate tapers from back to front, and said insertion edges each have a knife-like forwardly projecting tapered edge.

7. The method of claim 5 wherein said tool plate is provided with an aperture located near a back edge of said plate with said hand grip being defined between said back edge and said aperture.

8. The method of claim 5 wherein said tool plate tapers from back to front, and said insertion edges each have a knife-like forwardly projecting tapered edge; and wherein said plate is provided with an aperture located near a back edge of said plate with said hand grip being defined between said back edge and said aperture.

* * * * *